US005461398A

United States Patent [19]

Tang et al.

[11] Patent Number: 5,461,398

[45] Date of Patent: Oct. 24, 1995

[54] VIDEO PREAMPLIFIER WITH FAST BLANKING AND HALFTONE CAPABILITY ON A SINGLE INTEGRATED CIRCUIT CHIP

[75] Inventors: Y. W. Tang, Taipei; Timothy Chiu; Johnson Chiang, both of Taipei Hsien, all of Taiwan

[73] Assignee: Texas Instruments Incorporated, Dallas, Tex.

[21] Appl. No.: 250,250

[22] Filed: May 27, 1994

[51] Int. Cl.[6] ..... G09G 5/40

[52] U.S. Cl. ..... 345/116; 345/141; 348/589

[58] Field of Search ..... 345/116, 141, 345/144; 348/589, 598, 600

[56] References Cited

U.S. PATENT DOCUMENTS 5,003,303 3/1991 Kellar et al. ..... 345/144

*Primary Examiner*—Jeffery Brier

*Attorney, Agent, or Firm*—W. Daniel Swayze, Jr.; W. James Brady, III; Richard L. Donaldson

[57] ABSTRACT

A method and circuit (30) for providing drive signals that have a half-tone and fast blanking capability to a video display (20) has a video preamplifier (31) integrated on a semiconductor substrate (35) for receiving an input video signal (14) and for producing an output drive signal (17) to the video display (20). The preamplifier (31) may have a plurality of channels (31', 31") corresponding to each color video signal to be processed. A halftone control circuit (21), also integrated on the semiconductor substrate (35) receives halftone control signals (60) and connected to reduce the drive signal produced by the video preamplifier (31). A fast blanking circuit (22) for receiving fast blanking control signals (80) is also integrated on the semiconductor substrate (35) and is connected to substantially turn off the drive signal produced by the video preamplifier (31). The preamplifier (31) is constructed with bipolar transistors and the halftone and fast blanking control circuits are constructed with MOS transistors, for example by a LinBiCMOS semiconductor manufacturing process. The preamplifier (31) may include a plurality of amplification stages, (40, 43–45, 48, 50) wherein the halftone control circuit (21) and the fast blanking control circuits (22) control a drive level prior to a last amplification stage (50) to enable low level control of the halftone and fast blanking operations.

23 Claims, 2 Drawing Sheets

VIDEO PREAMPLIFIER WITH FAST BLANKING AND HALFTONE CAPABILITY ON A SINGLE INTEGRATED CIRCUIT CHIP

BACKGROUND OF THE INVENTION

1. Field of the Invention

This invention relates to improvements in video preamplifier circuits or the like that are integrated onto a semiconductor substrate and which include halftone and fast blanking capabilities, and more particularly to improvements in circuitry for providing fast blanking and halftone control of an on-screen display of a color monitor.

2. Relevant Background

In color monitor systems typically used in personal computer applications, or the like, frequently it is desirable to have an on-screen display (OSD) capability. Such OSD capability makes possible the display of supplemental information that may be of interest concurrently with the normal picture being displayed. Such supplemental information may be, for example, the number and content of the buffers associated with an associated computer system, the status of the CPU registers, clock information, disk usage information, and so forth.

In the past, fast blanking capabilities have been provided in which the video information provided to the display screen is entirely blanked for certain portions of the display. This results in a window that is entirely black in which OSD information can be written and displayed.

In another prior embodiment, the video in the window is only partially blocked, for instance to ½ or ⅓ of the normal amplitude. This display condition is referred to as "halftone" (even though the video magnitude may not be exactly ½ of the full scale video value.) In this display condition, if OSD characters are to be displayed in the halftone window, a "fast blanking" capability is generally provided. The fast blanking capability produces a full video blanking of the portion of the video within the halftone window at which the OSD information is to be displayed.

Generally in the past, the OSD information has been digitally generated by a digital circuit under the control of the CPU, separately from the linear video preamplifier. The OSD information is then added to the video output lines between the video preamplifier and the video power driver stage that delivers the video drive signals to the video display. It can be seen that the fast blanking, halftone, and OSD information must be properly synchronized with the normal video display information in order that it correctly display. As the digital OSD circuitry is located externally from the video preamplifier circuit, extra connection pins must be provided between the fast blanking signal output and the video preamplifier, and between the halftone control signal and the video preamplifier in order to properly control the video output of the video preamplifier to enable the OSD characters to be inserted into the video picture displayed. The form of the halftone and fast blanking signals was only control pulses sent to the preamplifier. This presupposes that the preamplifier is designed to receive and process the halftone and fast blanking pulses to realize the OSD display.

Moreover, in the past, the control of the preamplifier video drive signals has been located in the output stage of the video preamplifier circuit. This resulted in a requirement for relatively large current handling capabilities, requiring larger control transistor devices, a large number of discrete components in control and blanking circuitry, and a larger number of connection pins from the preamplifier package.

SUMMARY OF THE INVENTION

In light of the above, it is, therefore, an object of the invention to provide an improved method and circuit for providing fast blanking and halftone control of an on-screen display of a color video monitor.

It is yet another object of the invention to provide a method and apparatus for accomplishing fast blanking and halftone control of a video signal that can be realized in a single integrated circuit chip.

It is still another object of the invention to provide a method and circuit for accomplishing halftone and fast blanking control of a video signal that has relaxed component size constraints.

It is still another object of the invention to provide a circuit for accomplishing halftone and fast blanking control of a video signal that can be fabricated using a LinBiCMOS semiconductor manufacturing process.

These and other objects, features and advantages of the invention will be apparent to those skilled in the art from the following detailed description of the invention, when read in conjunction with the accompanying drawings and appended claims.

According to a broad aspect of the invention, a circuit is presented for providing drive signals that have a half-tone and fast blanking capability to a video display. The circuit has a video preamplifier integrated on a semiconductor substrate for receiving an input video signal and for producing an output drive signal to the video display. The preamplifier may have a plurality of channels corresponding to each color video signal to be processed. A halftone control circuit, also integrated on the semiconductor substrate, receives halftone control signals and is connected to reduce the drive signal produced by the video preamplifier. A fast blanking circuit for receiving fast blanking control signals is also integrated on the semiconductor substrate and is connected to substantially turn off the drive signal produced by the video preamplifier.

In one embodiment, the preamplifier is constructed with bipolar transistors, in which the halftone and fast blanking control circuits are constructed with MOS transistors, for example by a LinBiCMOS process. The preamplifier may include a plurality of amplification stages, wherein the halftone control circuit and the fast blanking control circuits control a drive level prior to a last amplification stage to enable low level control of the halftone and fast blanking operations.

According to another broad aspect of the invention, a method is presented for controlling halftone and fast blanking operations in a video display. The method includes the steps of providing a video preamplifier, a halftone control circuit, and a fast blanking control on a semiconductor substrate, and connecting the halftone control circuit and the fast blanking control circuit to vary a video drive level provided from the preamplifier. In a preferred embodiment, the video preamplifier, halftone control circuit, and fast blanking control are fabricated using a LinBiCMOS process, with the preamplifier being constructed with bipolar transistors and the halftone control circuit and the fast blanking control circuit being constructed with MOS transistors.

BRIEF DESCRIPTION OF THE DRAWINGS

The invention is illustrated in the accompanying drawings, in which.

DETAILED DESCRIPTION OF THE PREFERRED EMBODIMENTS

Although the methods and circuits of the invention can be used in conjunction with either monochrome or color video displays, the description below is presented for a color display. A monochrome embodiment would be represented by the elimination of the extra color channels required in a color system. In a typical color monitor system, for example, three colors are popularly used, red, green, and blue. It will be understood, of course, that other color systems besides the popularly used red, green, and blue color system may be employed in conjunction with the operation of the circuit of the invention. Moreover, the principles of operation can be equally advantageously employed in color systems that use color combination principles other than a three color system, two or four colors, for example, being known and used, but not presently receiving widespread acceptance or use.

Figure 1:
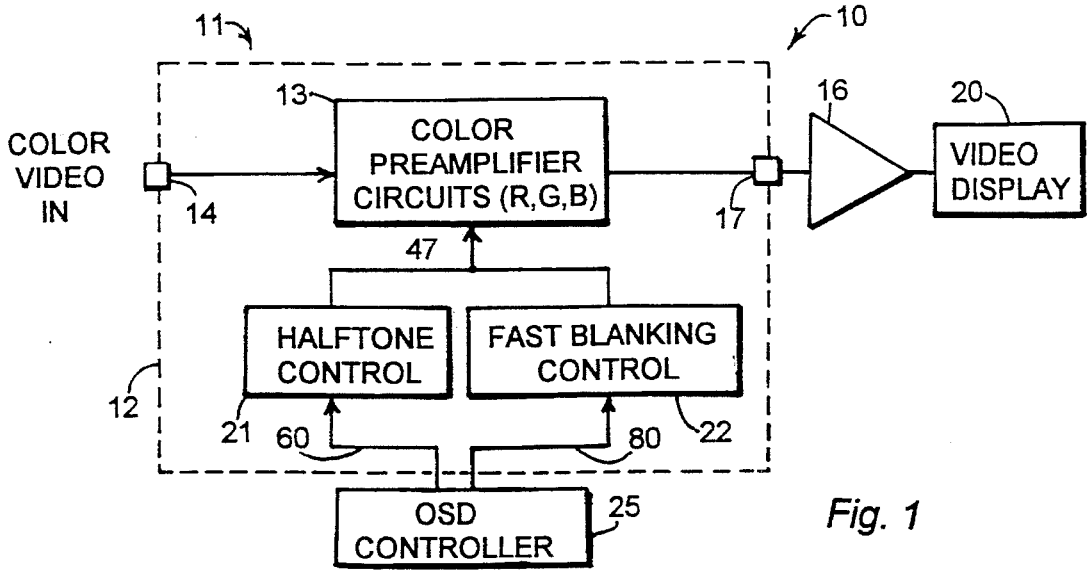
FIG. 1 is an electrical box diagram of a circuit in accordance with the invention to provide on-chip capabilities for halftone and fast blanking of a video signal.

An electrical box diagram of a circuit 10 in accordance with an embodiment of the invention to provide on-chip capabilities for halftone and fast blanking of a video signal is shown in FIG. 1. The circuit 10 includes a video preamplifier portion 11 formed on a semiconductor substrate 12. The video preamplifier 11 includes a number of color preamplifier circuits 13, corresponding to the number of video color signals being processed, normally the three primary video color signals, red, green, and blue. The color preamplifier circuits 13 receive their respective video inputs from one or more video input pins 14, and provide an output to a drive amplifier 17 on an output pin 17 to drive a conventional video display 20. Additionally formed on the semiconductor substrate 12 are a halftone control circuit 21 and fast blanking control circuit 22, each of which control the drive output from the color preamplifiers 13 to the drive amplifier 16.

The halftone 21 and the fast blanking 22 control circuits are controlled by an OSD controller or equivalent circuitry 25 or other video control device. Also, as will become apparent, the halftone 21 and fast blanking 22 control circuits operate to control a low voltage preamplifier input, thereby enabling reduction in the size and current capabilities of the components required in the realization of the circuit 10.

Figure 2A:
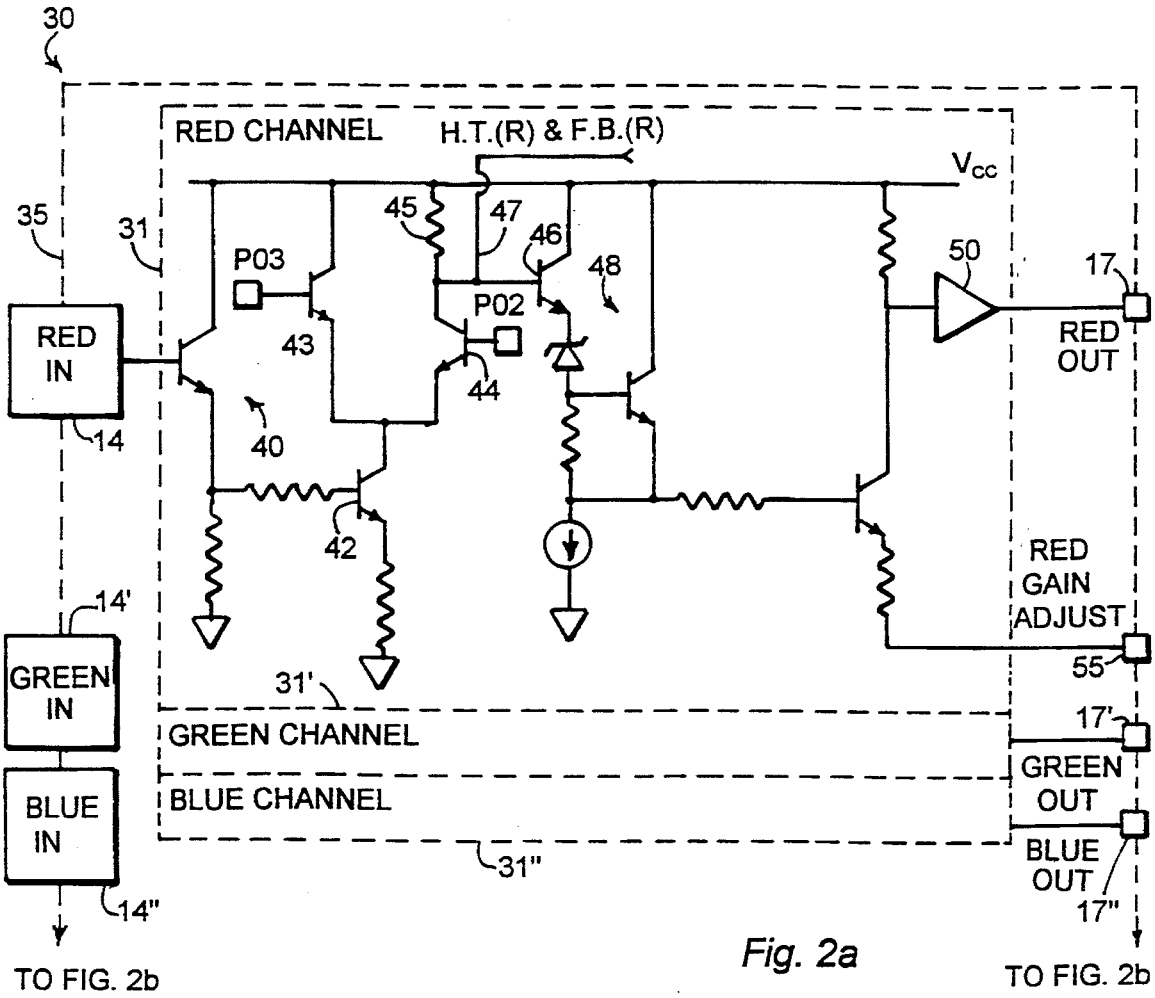
FIGS. 2*a* is a detailed electrical schematic diagrams of the color preamplifier circuits of the integrated circuit portion of FIG. 1.
Figure 2B:
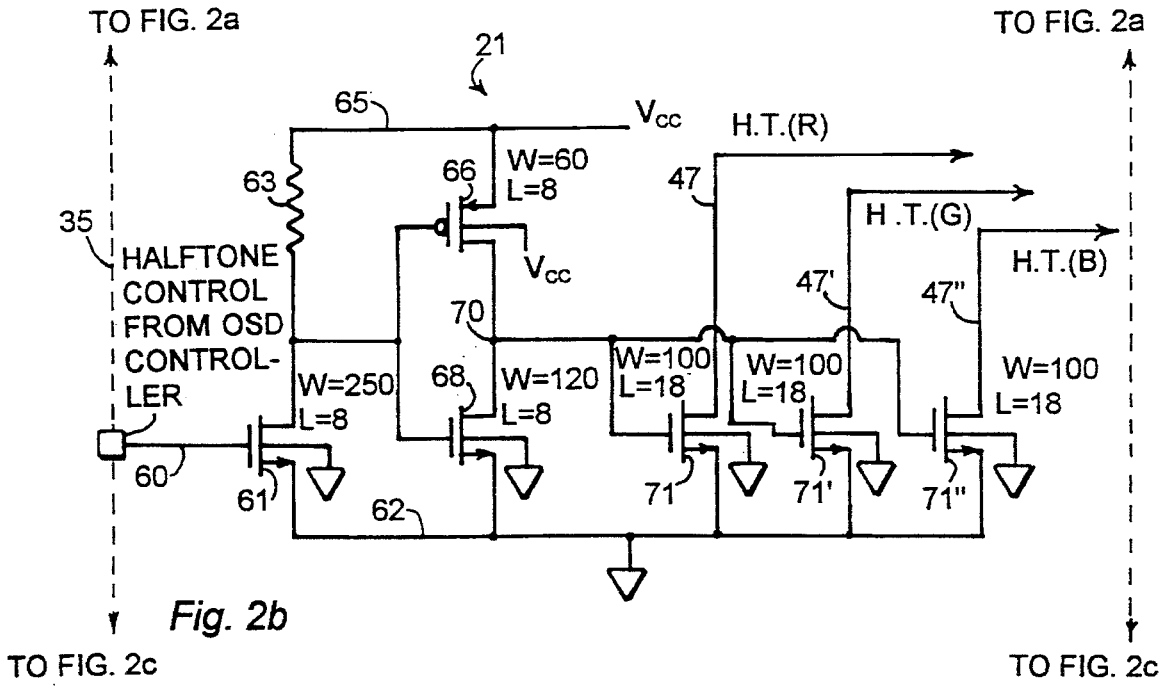
FIGS. 2*b* is a detailed electrical schematic diagrams of the halftone control circuit of the integrated circuit portion of FIG. 1.
Figure 2C:
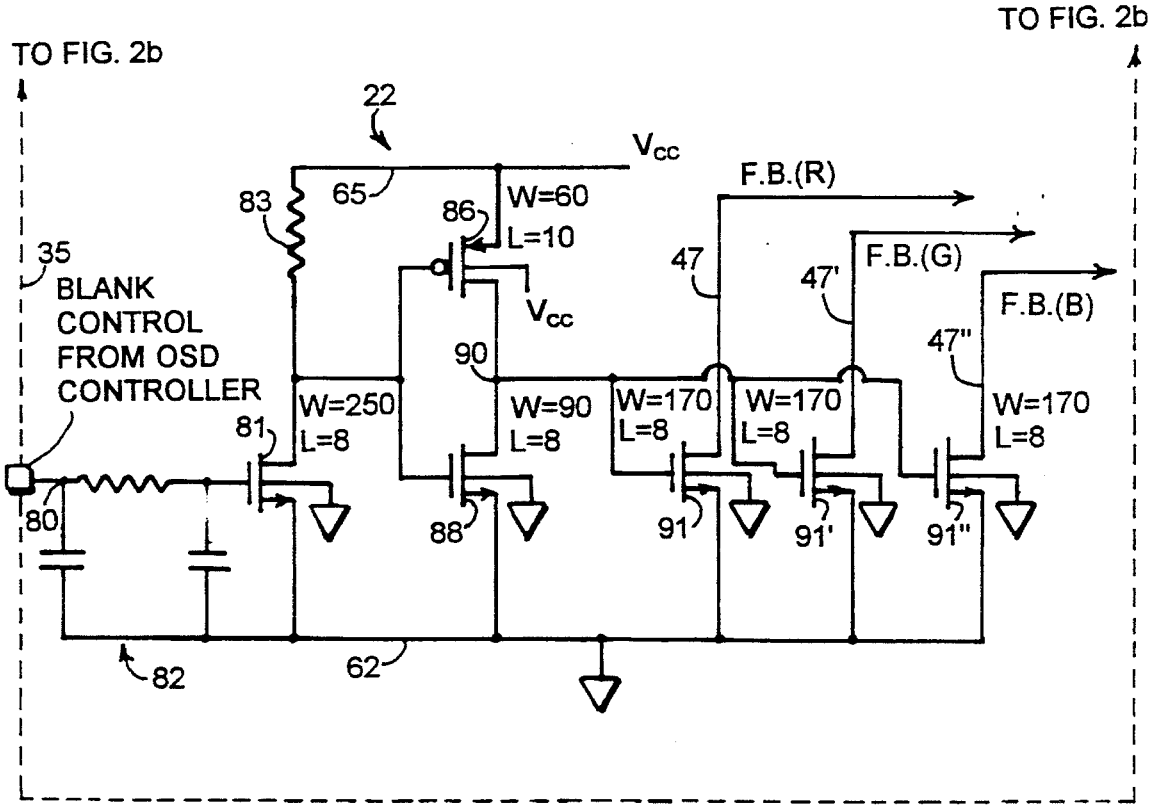
FIGS. 2*c* is a detailed electrical schematic diagrams of the fast blanking control circuit of the integrated circuit portion of FIG. 1.

A detailed electrical schematic diagram 30 of the integrated circuit portion 11 of FIG. 1 is shown in FIGS. 2*a*–2*c*. In the circuit embodiment shown in FIGS. 2*a*–2*c*, only the red channel 31 is shown, but it will be understood that similar green and blue channels, denoted by dotted line boxes 32' and 32", would be provided in a three color system, connected in a similar fashion, to enable the circuit 30 to deliver output signals to drive the red, green, and blue electron guns of a CRT or red, green, and blue signal processing paths of other types of information display, well known in the art.

In the circuit of FIGS. 2*a*–2*c*, the preamplifier circuit 13 (FIG. 2*a*), the halftone control circuit 21 (FIG. 2*b*), and fast blanking control circuit 22 (FIG. 2*c*) are constructed on an integrated circuit chip, denoted by the dotted line 35. In the construction of the red channel preamplifier circuit 31, an input pin 14 is provided to which an externally generated red video signal may be connected for amplification and processing by the circuit 30. The first amplifier stage to which the red input signal is applied is an emitter follower amplifier 40 that provides an input to an NPN transistor 42 that controls the overall current flowing in the differential amplifier defined by NPN transistors 43 and 44. The differential amplifier transistor 43 and 44 receive their base inputs respectively from terminals denoted P03 and P02, which may receive for example contrast control signals. An example of a circuit that may be used to provide such control signals is shown in copending patent application Ser. No. 08/234,395, (Attorney Docket Number TI-17719) assigned to the assignee hereof, and incorporated herein by reference. Thus, depending upon the level of the contrast desired as determined by the currents applied to the pins P02 and P03 from the contrast control circuit, the ratio of currents flowing through the NPN transistor 43 or 44 controls the voltage developed across the collector resistor 45 in the current path of the NPN transistor 64.

The voltage at the collector of the NPN transistor 44 is connected to the base of an amplifier transistor 46, the output level of which being shifted by level shifting circuit 48 and applied to the input of an output amplifier 50. Additionally, a line 47 is connected to the half control circuit 21 and the fast blanking control circuit 22, below described. As will become apparent, the halftone control circuit 21 or fast blanking circuit 22 control a level of current extracted from the base of the NPN transistor 46, thereby controlling the drive level output developed by the circuit 31. Similar connections are made on lines 47' and 47" of the green channel preamplifier circuit 32' and blue channel preamplifier circuit 32".

A detailed electrical schematic diagrams of the halftone control circuit 21 is shown in FIG. 2*b*. The halftone control circuit 21 is formed on the same semiconductor substrate 35 as the preamplifier circuit 31 shown in FIG. 2*a*. The halftone control circuit 21 receives its control signals from the external OSD controller or equivalent circuitry 25 on an input line 60, the signals being applied to the gate of an n-channel MOS (NMOS) transistor 61. The NMOS transistor 61 has its source connected to a reference potential, or ground, rail 62, and its drain connected to one end of a load resistor 63. The other end of the load resistor 63 is connected to a supply voltage, Vcc, rail 65. The output at the drain of the NMOS transistor 61 is applied to the respective gates of a p-channel MOS (PMOS) transistor 66 and an NMOS transistor 68 to control the voltage at the node 70 connected to their respective drains. When the NMOS transistor 68 conducts, the node 70 is at the potential of the reference rail 62, and when the PMOS transistor conducts, the node 70 is at the potential of the supply rail 65 (less, of course, the voltage drops across the respective transistors). The voltage on the node 70 controls the conduction through the red, green, and blue halftone control transistors 71, 71' and 71". The red, green, and blue halftone control transistors 71, 71' and 71" are sized so that when they are active, they pull a current from the base of the NPN transistor 46 of the preamplifier circuit 31 to reduce the amount of video drive by ½, ⅓, or other desired amount to produce the halftone effect preferred in the final video display. In the embodiment shown, for example, the channel dimensions are sized with the relative width to length (W/L) ratio of 100/18.

A detailed electrical schematic diagram of the fast blanking control circuit 22 is shown in FIG. 2*c*. The blanking circuit 22 shown in FIG. 2*c* is of similar construction to the halftone circuit 21, except for the sizing of the red, green, and blue fast blanking transistors 91, 91' and 91". The fast blanking control circuit 22 is formed on the same semiconductor substrate 35 as the preamplifier circuit 31 shown in FIG. 2*a*. The fast blanking control circuit 22 also receives its control signals from the external OSD controller or equivalent circuitry 25 on an input line 80, the signals being applied to the gate of an n-channel MOS (NMOS) transistor 81. As shown, an input filter 82 may be provided to precondition the input signal on line 80. The NMOS transistor 81 has its source connected to the reference potential, or ground, rail 62, and its drain connected to one end of a load resistor 83. The other end of the load resistor 83 is connected to the supply voltage, Vcc, rail 65. The output at the drain of the NMOS transistor 81 is applied to the respective gates of a PMOS transistor 86 and an NMOS transistor 88 to control the voltage at the node 90 connected to their respective drains. When the NMOS transistor 88 conducts, the node 90 is at the potential of the reference rail 62, and when the PMOS transistor conducts, the node 90 is at the potential of the supply rail 65 (less, of course, the voltage drops across the respective transistors). The voltage on the node 90 controls the conduction through the red, green, and blue fast blanking control transistors 91, 91' and 91". The red, green, and blue fast blanking control transistors 91, 91' and 91" are sized so that when they are active, they pull a current from the base of the NPN transistor 46 of the preamplifier circuit 31 to reduce the amount of video drive by a sufficient amount to blank or substantially turn off the final video display. In the embodiment shown, for example, the channel dimensions are sized with the relative width to length (W/L) ratio of 170/8.

Thus, in the operation of the circuit 30, when the video drive is to be adjusted to produce a halftone effect, the OSD controller or equivalent circuitry 25 produces a signal on line 60 to the halftone control circuit 21. The halftone control transistors 71, 71', and 71" are activated to adjust the voltage at the gate of the transistor 46 to produce the desired halftone drive to the video output. Similarly, when the video drive is to be adjusted to produce a fast blanking effect, the OSD control circuit or equivalent circuitry 25 produces a signal on line 80 to the fast blanking control circuit 22. The fast blanking control transistors 91, 91', and 91" are activated to adjust the voltage at the gate of the transistor 46 to produce the desired blanking drive to the video output.

It will be appreciated that since the circuit 30 includes both bipolar and MOS transistors, the circuit 30 may be fabricated by a suitable LinBiCMOS process, such LinBiCMOS processes being known in the art. It will also be appreciated that since both the halftone control circuit 21 and fast blanking control circuit 22 adjust low level input voltages within the preamplifier, the component requirements are greatly relaxed from those that would be required if the halftone and fast blanking operations were performed at the output of the preamplifier or at the input of the display device.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A circuit for providing drive signals having a halftone and fast blanking capability to a video display, comprising:

a video preamplifier integrated on a semiconductor substrate for receiving an input video signal and for producing an output drive signal to the video display;

a halftone control circuit for receiving halftone control signals, integrated on said semiconductor substrate and connected to reduce the drive signal produced by said video preamplifier;

a fast blanking circuit for receiving fast blanking control signals, integrated on said semiconductor substrate and connected to substantially turn off the drive signal produced by said video preamplifier.

2. The circuit of claim 1, wherein said video preamplifier is formed with bipolar transistors and wherein said halftone and fast blanking control circuits are formed with MOS transistors.

3. The circuit of claim 1, wherein said video preamplifier comprises a plurality of amplification stages, and wherein said halftone control circuit and said fast blanking control circuit control a drive level prior to a last amplification stage.

4. The circuit of claim 1, wherein said video preamplifier comprises a plurality of amplification stages and wherein said halftone control circuit and said fast blanking control circuit each comprise control transistors to control a drive level prior to a last amplification stage.

5. The circuit of claim 4, wherein said control transistors of said halftone control circuit are sized smaller than said control transistors of said fast blanking circuit.

6. The circuit of claim 1, wherein said halftone control circuit comprises a halftone input transistor to receive the halftone control signals to produce an additional halftone control signal, complementary MOS transistors connected between a supply voltage and a reference voltage to control a voltage on an intermediate halftone control node, and at least one halftone control transistor connected to said video preamplifier to adjust the drive output thereof in accordance with the voltage on the intermediate halftone control node.

7. The circuit of claim 6, wherein said video preamplifier, comprises a plurality of substantially identical color channels, each for connection to receive respective color video input signals, and wherein said halftone control circuit comprises a corresponding plurality of halftone control transistors, each connected to a respective one of said color channels of said video preamplifier to adjust the drive output thereof in accordance with the voltage on the intermediate halftone control node.

8. The circuit of claim 6, wherein said halftone input transistor and said at least one halftone control transistors are MOS transistors.

9. The circuit of claim 1, wherein said fast blanking circuit comprises a fast blanking input transistor to receive the fast blanking control signals to produce a fast blanking control signal, complementary MOS transistors connected between a supply voltage and a reference voltage to control a voltage on an intermediate fast blanking control node, and at least one fast blanking control transistor connected to said video preamplifier to adjust the drive output thereof in accordance with the voltage on the intermediate fast blanking control node.

10. The circuit of claim 9, wherein said fast blanking input transistor and said at least one fast blanking control transistors are MOS transistors.

11. The circuit of claim 9, wherein said video preamplifier comprises a plurality of substantially identical color channels, each for connection to receive respective color video input signals, and wherein said fast blanking control circuit comprises a corresponding plurality of fast blanking control transistors, each connected to a respective one of said color channels of said video preamplifier to adjust the drive output thereof in accordance with the voltage on the intermediate fast blanking control node.

12. The circuit of claim 1, wherein said video preamplifier comprises an input buffer stage for connection to receive the video input signal to produce a buffered video signal, a differential amplifier for amplifying the buffered video signal to produce an amplified buffered video signal, and wherein a second video amplifier fast blanking input transistor and said at least one fast blanking control transistors are MOS transistors.

13. A circuit for providing drive signals having a halftone and fast blanking capability to a color video display, comprising:

a video preamplifier integrated on a semiconductor substrate, having a plurality of preamplifier channels for receiving a corresponding plurality of respective color input video signals and for producing a corresponding plurality of color output drive signals to the color video display;

a halftone control circuit for receiving halftone control signals, integrated on said semiconductor substrate and connected to reduce the drive signals produced by each of said preamplifier channels;

a fast blanking circuit for receiving fast blanking control signals, integrated on said semiconductor substrate and connected to substantially turn off the drive signals produced by said each of said preamplifier channels.

14. The circuit of claim 13, wherein said video preamplifier is formed with bipolar transistors and wherein said halftone and fast blanking control circuits are formed with MOS transistors.

15. The circuit of claim 13, wherein each of said preamplifier channels comprises a plurality of amplification stages, and wherein said halftone control circuit and said fast blanking control circuit control a drive level prior to a last amplification stage in each of said preamplifier channels.

16. The circuit of claim 13, wherein each of said preamplifier channels comprise a plurality of stages and wherein said halftone control circuit and said fast blanking control circuits each comprise control transistors to control a drive level prior to a last amplification stage in each of said preamplifier channels.

17. The circuit of claim 16, wherein said control transistors of said halftone circuit are sized smaller than said control transistors of said fast blanking control circuit.

18. The circuit of claim 13, wherein said halftone control circuit comprises a halftone input transistor to receive the halftone control signals to produce a halftone control signal, complementary MOS transistors connected between a supply voltage and a reference voltage to control a voltage on an intermediate halftone control node, and a plurality of halftone control transistors connected to respective preamplifier channels circuits to adjust the drive output thereof in accordance with the voltage on the intermediate halftone control node.

19. The circuit of claim 13, wherein said fast blanking circuit comprises a fast blanking input transistor to receive the fast blanking control signals to produce an additional fast blanking control signal, complementary MOS transistors connected between a supply voltage and a reference voltage to control a voltage on an intermediate fast blanking control node, and a plurality of fast blanking control transistors connected to respective preamplifier channels to adjust the drive output thereof in accordance with the voltage on the intermediate fast blanking control node.

20. A method for controlling halftone and fast blanking operations in a video display, comprising:

forming a video preamplifier, a halftone control circuit, and a fast blanking control circuit on a semiconductor substrate;

connecting said halftone control circuit and said fast blanking control circuit to vary a video drive level provided from said video preamplifier.

21. The method of claim 20, wherein said step of forming said video preamplifier, halftone control circuit, and fast blanking control on a semiconductor substrate comprises the step of fabricating the video preamplifier, halftone control circuit, and fast blanking control circuit on the semiconductor substrate using a LinBiCMOS process.

22. The method of claim 20, wherein said step of forming said video preamplifier, halftone control circuit, and fast blanking control on a semiconductor substrate comprises the step of fabricating the video preamplifier with bipolar transistors and said halftone control circuit and said fast blanking control circuit with MOS transistors.

23. The method of claim 20, wherein said step of forming a video preamplifier comprises the step of forming a video preamplifier having multiple preamplification stages, and wherein said step of connecting said halftone control circuit and said fast blanking control circuit to vary a video drive level provided from said preamplifier comprise the step of connecting said halftone control circuit and said fast blanking control circuit to control an amplification stage of said preamplifier prior to a last amplification stage.

* * * * *